United States Patent [19]

Dergazarian et al.

[11] 3,936,330

[45] Feb. 3, 1976

[54] COMPOSITION AND METHOD FOR INFLATION OF PASSIVE RESTRAINT SYSTEMS

[75] Inventors: Thomas E. Dergazarian; George A. Lane, both of Midland, Mich.

[73] Assignee: The Dow Chemical Company, Midland, Mich.

[22] Filed: Aug. 8, 1973

[21] Appl. No.: 386,815

[52] U.S. Cl. ..... 149/35; 149/42; 149/75; 149/77; 149/82; 280/150 AB

[51] Int. Cl.[2] ..... C22C 37/00

[58] Field of Search ..... 149/35, 42, 75, 77, 82; 280/150 AB

[56] References Cited

UNITED STATES PATENTS

| | | | |
|---|---|---|---|
| 2,981,616 | 4/1961 | Boyer | 149/35 |
| 3,718,513 | 2/1973 | Baer et al. | 149/35 X |
| 3,785,674 | 1/1974 | Poole et al. | 149/35 X |

*Primary Examiner*—Stephen J. Lechert, Jr.
*Attorney, Agent, or Firm*—Bruce M. Kanuch; G. H. Korfhage

[57] ABSTRACT

Disclosed is a pyrotechnic composition and a method for the inflation of passive restraint systems, i.e., crash bags. The method utilizes gases produced by the ignition and burning of a pyrotechnic composition containing an alkali metal azide, a metal halide and an inorganic perchlorate.

17 Claims, No Drawings

COMPOSITION AND METHOD FOR INFLATION OF PASSIVE RESTRAINT SYSTEMS

BACKGROUND OF THE INVENTION

In recent years emphasis has been placed upon the development of systems for holding automobile passengers in their seats during the sudden deceleration experienced as a result of a collision. Seat belts and shoulder harnesses have been shown to be effective to decrease both the frequency and the severity of injuries resulting from automobile accidents. However, these devices suffer from one major drawback. They must be buckled by the passenger. The widespread failure on the part of the motoring public to "buckle up" has led to a demand for devices which will hold the passenger in his seat without the need for any overt act. Such a passive restraint system would be built into the automobile and be automatically activated upon a collision.

One promising passive restraint system is the inflatable gas cushion or crash bag. In this system, a flow of gas is employed to rapidly fill a flexible bag upon activation of the system. The inflated bag provides cushioning during the rapid deceleration, thus preventing contact of the occupant with the car interior and reducing the chance of serious injury during an accident. After the initial contact, the bag slowly deflates to avoid entrapment of the passenger. During this process, gases employed to inflate the bag also escape into the atmosphere surrounding an occupant. Thus, the gases must not in themselves be detrimental to human health since the benefits of the restraint system would then be lost.

One type of crash bag system employs high pressure nitrogen stored in a gas bottle to fill a bag. Activation of the unit releases the nitrogen which flows into the bag. Such a stored gas system is undesirable from the standpoint of cost and poor adaptability to automotive styling caused by its size and weight. An alternative to the compressed gas system lies in the use of a pyrotechnic gas generator. In this system, a small pyrotechnic charge is set off upon activation and upon burning evolves sufficient gas to fill the bag. This type of system offers a cost advantage as well as adaptability to a relatively compact light weight generating device such as that disclosed in a copending application entitled "Gas Generator," filed in the U.S. Pat. Office by Gerald R. Staudacher, et al. on July 31, 1972 as application Ser. No. 276,397.

In order for a pyrotechnic to be useful in such a system, the composition of the pyrotechnic must meet several criteria. First, the composition must release sufficient gas to fill a bag of suitable volume to a pressure of at least about one psig. within 20 to 60 milliseconds after ignition. Secondly, the gases released upon ignition of the pyrotechnic composition should not be toxic to the automobile occupants. In addition, the gas produced should not increase the temperature of the bag to the point of causing serious thermal injury or pain. Furthermore, the noise level upon functioning should remain below about 170 DB and preferably below 150 DB. A further requirement is that such a composition should remain operable between temperatures ranging from about −20° to about 220°F.

It is an object of the present invention to provide a method and composition for inflating crash bag type passive restraint systems which meets or exceeds the above criteria.

SUMMARY OF THE INVENTION

The pyrotechnic composition of the present invention comprises an intimate mixture of an alkali metal azide, a metal halide and an inorganic perchlorate oxidizer. The composition may optionally contain granulated carbon, such as graphite, and a particulate metal which acts as a scavenger during the burning of the composition to reduce such toxic materials as CO, HCN and NO.

DETAILED DESCRIPTION OF THE INVENTION

The composition of the present invention comprises an intimate mixture, preferably in a compacted form, i.e., a grain, of an alkali metal azide designated by the formula $MN_3$ wherein M is an alkali metal, preferably potassium or sodium: a metal halide represented by the formula $RX_n$ wherein X is Cl, Br or I, preferably Cl, R is selected from the group consisting of Ca, Co, Ni, Sn, Zn or Mg and n is equal to the valence of R. Also included is an inorganic perchlorate oxidizer represented by the general formula $A(ClO_4)_m$ wherein A is potassium, sodium, or magnesium, and $m$ is equal to the valence of A.

The above-defined constituents should be provided in amounts to allow the following reaction to proceed:

$$MN_3+A(ClO_4)_m+RX_n \rightarrow MX + N_2 + ACl_m + RO \text{ (or } R_2O_n)$$

Preferably, the composition should be stoichiometric or under-oxidized to minimize nitrogen oxide formation and to suppress the following reaction:

$$MN_3+A(CLO_4)_m \rightarrow N_2 + ACl_m + M_2O$$

since the alkali metal oxides are generally toxic.

A particulate metal fuel, for example, magnesium, aluminum, titanium, silicon, or zinc, is optionally provided in a minor to react with such toxic constituents of the combustion reaction as hydrogen cyanide, carbon monoxide or nitric oxide to produce a corresponding metal oxide which is generally nontoxic.

Graphite may also be added in a minor amount to aid in manufacturing processes and in maintaining the physical integrity of the pyrotechnic grain.

The composition preferably contains an intimate mixture of the following constituents, as percent by weight: $MN_3$, about 48 to about 53 percent; $RX_n$, about 32 to about 40 percent; $A(ClO_4)_m$, about 10 to about 15 percent; a particulate metal, 0 to about 5 percent and graphite, from 0 to about 2 percent.

One preferred pyrotechnic composition comprises, as percent by weight, sodium azide, about 50.7 percent; potassium perchlorate, about 12.2 percent and magnesium chloride, about 37.1 percent. Another preferred composition comprises 49.7% $NaN_3$, 11.9% $KClO_4$, 36.4% $MgCl_2$, graphite, about 1 percent and magnesium powder, about 1 percent.

The pyrotechnic composition of the present invention comprises an intimate mixture, preferably compressed, containing the constituents in a particulate form having a particle size preferably of about 250 microns or less. It is preferred that the grain be substantially water free.

One method of forming propellant grains of the present invention comprises first separately drying the constituents of the composition at a temperature ranging from about 80° to about 100°C. The particulate materials are then ground to a particle size of about 250 microns or less. The required amount of each ingredient is then incorporated into a blending device, sealed and placed on blending rolls. The dry powder is blended together for a minimum of about 2 hours. The blended pyrotechnic powder is then compressed into grains of a desired weight, diameter and density. For example, 2 inch diameter grains should be compacted at a pressure of about 17,000–17,500 psi.

The so-produced grains may be employed in many different processes wherein the gases or pressures generated by the burning of the grain are desired. A particularly useful process wherein the grain provides a definite improvement comprises generating gases to inflate passive restraint systems. These systems generally consist of a gas generator which is in fluid connection with an inflatable cushion or bag. The gas generator is connected to a deceleration sensor and activation means. Upon sensing a certain minimum deceleration, e.g., a crash, the sensor activates the gas generator and the pyrotechnic composition is ignited, producing gases which immediately flow to the bag and inflate the same to protect the occupant of the automobile. The following examples will facilitate a more complete understanding of the present invention.

EXAMPLE 1

Pressed grains were prepared containing as a base ingredient, as parts by weight, 50.7 parts sodium azide, 12.2 parts potassium perchlorate and 37.1 parts magnesium chloride. The grains were prepared in the manner set forth hereinbefore in the specification. Several other grains were prepared containing the same basic ingredients and in addition certain amounts of graphite, particulate magnesium or particulate magnesium and graphite together. These grains were employed to inflate inflatable bags employing a gas generator such as that disclosed in U.S. Pat. application Ser. No. 276,397 described hereinbefore. The combustion gases were analyzed for potentially toxic species. Mass spectrometry, infrared spectroscopy, and colorimetric reaction tube analysis of the combustion gases were performed. The compositions of the grains tested and the resulting analysis of the combustion gases are set forth in the following Table I.

formula $A(ClO_4)_m$ wherein M is an alkali metal; R is tin, zinc, cobalt, nickel, calcium or magnesium; X is chlorine, bromine or iodine, n is an integer representing the valence state of R; A is potassium, sodium, or magnesium and m is equal to the valence of A, said constituents provided in amounts so that upon burning of the composition, the combustion products are substantially free of oxides of nitrogen, elemental alkali metals, HCN and alkali metal oxides.

2. The composition of claim 1 including in addition up to about 5 percent by weight of a particulate metal fuel.

3. The composition of claim 1 including in addition up to about 2 percent by weight of particulate graphite.

4. The composition of claim 1 wherein said constituents are provided in the following amounts as percent by weight; $MN_3$, about 48 to about 53 percent; $RX_n$, about 32 to about 40 percent and $A(ClO_4)_m$, about 10 to about 15 percent.

5. The composition of claim 4 including in addition up to about 5 percent by weight of a particulate metal selected from the group consisting of magnesium, aluminum, titanium, silicon or zinc.

6. The composition of claim 5 including in addition up to about 2 percent by weight of graphite.

7. The composition of claim 4 including up to about 2 percent by weight of graphite.

8. The composition of claim 4 wherein M is sodium or potassium.

9. The composition of claim 4 including in addition up to about 5 percent by weight of a particulate metal selected from the group consisting of magnesium, aluminum, titanium, silicon or zinc; up to about 2 percent by weight of graphite wherein all the constituents are provided in particulate form having a particle size of about 250 microns or less.

10. A pyrotechnic grain comprising: an intimate mixture of particles wherein said particles comprise, as percent by weight of the grain, sodium azide, about 50.7 percent; potassium perchlorate, about 12.2 percent; and magnesium chloride, about 37.1 percent, said

TABLE I

| Constituent in Combustion Gas | Basic Composition | Constituents in Combustion Gases: Basic Comp. + 2% by Wt. Graphite | Basic Comp. + 1% by Wt. Mg 2% by Wt. Graphite | Basic Comp. + 1% by Wt. Mg |
|---|---|---|---|---|
| $N_2$ | 95.5% (Mass Spec.) | | | |
| NO | 50–100 ppm. (Drager tube) | 150–300 ppm. | 70 ppm. | 0 |
| $NO_2$ | 0 ppm. (Drager tube) | | | |
| $H_2$ | 2.6% (Mass Spec.) | | | |
| $NH_3$ | 400–1700 ppm. (IR, Drager Tube) | >1% | <1% | >1% |
| HCN | 0–100 ppm. (Drager Tube) | 20–50 ppm. | 0 | 0 |
| $CH_4$ | 3300 ppm. (Mass Spec.) | | | |
| $O_2$ | 3700 ppm. (Mass Spec.) | | | |
| CO | 2000–6000 ppm. (Drager Tube) | .85%–1% | 1% | 3000 ppm. |
| $CO_2$ | 1600 ppm. (Mass Spec.) | | | |

What is claimed is:

1. A composition which burns to produce gases which are rich in nitrogen and substantially free of elemental alkali metals, oxides of nitrogen and alkali metal oxides, which comprises:

an intimate mixture of an alkali metal azide of the formula $MN_3$, a metal halide of the formula $RX_n$ and an inorganic oxidizer corresponding to the grain being further characterized in that upon burning of the grain, the combustion products are substantially free of oxides of nitrogen, elemental alkali metals, HCN and alkali metal oxides.

11. A pyrotechnic grain comprising, as percent by weight:

about 49.7 percent $NaN_3$, about 11.9 percent $KClO_4$, about 36.4 percent $MgCl_2$, about 1 percent magnesium and about 1 percent graphite, said grain being further characterized in that upon burning of the grain, the combustion products are substantially free of oxides of nitrogen, elemental alkali metals, HCN and alkali metal oxides.

12. The composition of claim 11 wherein the individual constituents are in particulate form ranging in size from about 250 microns or less.

13. A method of rapidly generating gases which are rich in nitrogen and substantially free of elemental alkali metals, alkali metal oxides and oxides of nitrogen which comprises:

igniting an intimate mixture of an alkali metal azide of the formula $MN_3$, a metal halide of the formula $RX_n$ and an inorganic oxidizer corresponding to the formula $A(ClO_4)_m$ wherein M is an alkali metal; R is tin, zinc, cobalt, nickel, calcium or magnesium; X is chlorine, bromine or iodine, n is an integer representing the valence state of R; A is potassium, sodium, or magnesium, and m is equal to the valence of A, said constituents provided in amounts so that upon burning of the composition, the combustion products are substantially free of oxides of nitrogen, elemental alkali metals, HCN and alkali metal oxides.

14. The method of claim 13 wherein the mixture of metal azide and metal halide is ignited while in fluid communication with an inflatable flexible container, thereby filling and inflating the container with combustion gases upon ignition of the mixture.

15. The method of claim 14 wherein said container is located in an automobile.

16. The method of claim 15 wherein the mixture comprises, as percent by weight, about 50.7 percent sodium azide, about 12.2 percent potassium perchlorate and about 37.1 percent magnesium chloride.

17. The method of claim 14 wherein said mixture comprises, as percent by weight, about 49.7 percent $NaN_3$, about 11.9 percent $KClO_4$, about 36.4 percent $MgCl_2$, about 1 percent magnesium, and about 1 percent graphite.

* * * * *

UNITED STATES PATENT AND TRADEMARK OFFICE

CERTIFICATE OF CORRECTION

PATENT NO. : 3,936,330

DATED : February 3, 1976

INVENTOR(S) : Thomas E. Dergazarian et al.

It is certified that error appears in the above-identified patent and that said Letters Patent are hereby corrected as shown below:

Column 2, line 32, in the formula, change "CL" to --Cl--.

Column 2, line 36, insert the word --amount-- after "minor".

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*